US005619814A

United States Patent [19]

Herrndobler

[11] Patent Number: 5,619,814

[45] Date of Patent: Apr. 15, 1997

[54] SHAFTLESS GOLF CLUB HEAD PHOTOGRAPH HOLDER AND METHOD OF MAKING SAME

[76] Inventor: Timothy H. Herrndobler, 54 N. Winston Dr., Palatine, Ill. 60067

[21] Appl. No.: 48,670

[22] Filed: Apr. 16, 1993

[51] Int. Cl.[6] ..... A63B 53/04

[52] U.S. Cl. ..... 40/358; D19/82; D19/97

[58] Field of Search ..... 40/358; 273/167 S, 273/78; D11/159; D19/82, 97

[56] References Cited

U.S. PATENT DOCUMENTS

| | | | |
|---|---|---|---|
| D. 224,119 | 7/1972 | Scire . | |
| D. 242,704 | 12/1976 | Coatney . | |
| D. 270,899 | 10/1983 | Huang . | |
| D. 275,744 | 10/1984 | McJunkin et al. . | |
| D. 279,557 | 7/1985 | McJunkin . | |
| 3,172,667 | 3/1965 | Baker et al. | 273/78 |
| 4,391,053 | 7/1983 | Anthony | 40/152 |
| 5,221,087 | 6/1993 | Fenton et al. | 273/167 J X |
| 5,299,807 | 4/1994 | Hutin | 273/78 X |

OTHER PUBLICATIONS

"Golf Club Repair In Pictures", Fourth edition, May 1988.

*Primary Examiner*—Brian K. Green
*Assistant Examiner*—Cassandra Davis
*Attorney, Agent, or Firm*—Charles F. Meroni, Jr.

[57] ABSTRACT

A shaftless golf club head photograph holder and method of producing same wherein the head is crafted by placing a photograph, with or without framing means, into the front striking face of the head and securing the photograph in place by a two-sided adhesive tape in one instance and by transparent epoxy in a second instance to prevent misalignment of the photograph. The transparent epoxy also serves to allow an aesthetically pleasing viewing of the photograph. The entire head is mounted upon a heel plate which creates a horizontal planar surface which is then placed in fixedly mounted assembly with a decorative support base. The base has an ornamental letter plate to commemorate in letters, words, or symbols the nature or special meaning of the shaftless golf club head photograph holder to the viewer.

7 Claims, 5 Drawing Sheets

SHAFTLESS GOLF CLUB HEAD PHOTOGRAPH HOLDER AND METHOD OF MAKING SAME

FIELD OF THE INVENTION

The present invention relates to a shaftless golf club head photograph holder. More particularly, to a shaftless golf club head suitable for mounting on a decorative support base possessing the capability of fixed photograph placement within the striking face of the golf club head for viewing and to a method and process of producing same.

BACKGROUND OF THE INVENTION

There are numerous prior art devices which deal with the general idea of a golf club head with decorative characteristics. Typically, these "wood" or "driver" type golf clubs have been fashioned from various forms of wood. The heads of these golf clubs are constructed out of a solid piece of wood or wood laminae that is adhesively joined into a unitary body with or without an insert in the striking face of the golf club head.

U.S. Pat. No. 4,204,684 by Molitor discloses a golf club head and method of producing the same wherein the head is constructed of laminations or layers of resinous or plastic materials bonded together to form an integrated or composite head. This device employs a decorative effect through the use of resinous layers or laminations which have been pigmented with colorable flaky pigments such as pearl essence or metallic flake pigments which have a reflective three-dimensional effect. Similarly, in U.S. Pat. No. 4,508,350, Duclos discloses a golf club head which utilizes a decorative material such as polished brass as a cover within the striking face of the golf club head. This cover is simply placed upon the striking face and is not secured by epoxy or other type od adhesion material.

Other prior art devices reveal various designs of golf club heads. Many of these heads, such as those found in Des. 242,704, Des. 270,889, and Des. 279,557, depict a golf club head in an ornamental or decorative setting. However, none of these aforementioned prior art devices deal with the general idea of facilitating the placement of a photograph within the striking face of the golf club head which can be viewed through a layer of transparent epoxy which also serves to hold the photograph in a fixed position in the striking face of the head.

Further, a prior publication relates to "Replacing Old Inserts With Epoxy Cast-In-Place Inserts And Repairing Damaged Faces." This publication generally details a method of repairing the striking faces of the entire golf club to facilitate continued use of the club. In this method of construction the entire soleplate of the striking face is reinstalled into the club and secured with a high-impact strength epoxy so that the face of the club can withstand the force of striking a golfball. This type of epoxy insert also allows for the placement of a photograph in the striking face of the golf club head. However, this method is plagued with a series of major drawbacks. First, there is no safeguard in the method to prevent the photograph from moving or floating within the striking face of the golf club head. This failure to fix the placement of the photograph in the head can lead to reduce or inhibit the decorative effect of the head. Further, the method employs a cumbersome and confusing number of steps of construction. The entire soleplate must also be removed, replaced, and then reinstalled.

The present invention abrogates all of the drawbacks and flaws found in the prior art by employing a simple transparent epoxy application process which secures the photograph in a fixed position within the striking face. The present invention further provides two separate embodiments to secure the photograph in the striking face of the golf club head and thus prevent the photograph from floating or moving within the striking face. In the first embodiment a two-stage transparent epoxy application process is utilized wherein a first layer of epoxy is applied to the striking face of the head. While this first layer of epoxy is in a tacky state, a photograph is placed onto the layer of epoxy thereby securing the photograph in a fixed state. The second layer of transparent epoxy is then applied to encase and protect the photograph for viewing. In a second embodiment a two-sided adhesive tape is used to secure the photograph in a fixed position within the striking face of the head while a single layer of transparent epoxy is applied onto the photograph to encase and secure the photograph for viewing. Both of these embodiments yield fixed photograph placement and prevent the photograph from floating in the striking face and becoming misaligned or unviewable.

SUMMARY OF THE INVENTION

The shaftless golf club head photograph holder of my invention has a decorative support base, the golf club head is mounted on the base and includes means for securing the head to the base. The shaftless golf club head of my invention has a hosel extending upwardly from the head. The golf club head has an inclined surface simulating a striking face on a wood-type golf club head. The striking face has a concave center portion, and a photograph is adapted to be placed in a fixed position within the concave center portion. In one embodiment the photograph can be placed within an ornamental or decorative frame design such as a circle, square, or other like shapes and then secured in a fixed position within the striking face by means of a two-stage transparent epoxy application process which places the photograph and chosen frame design in a fixed and viewable position within the striking face of the golf club. A second embodiment allows for the fixed placement of a photograph itself without an accompanying frame design. In this embodiment tape is adhesively secured to the photograph having opposing adhesive tape surfaces. The adhesive on one side of the tape is secured to the photograph, and the adhesive on the other side of the tape secures the photograph in a centered position within the concave center portion of the golf club head. A layer of transparent epoxy then covers the photograph and fills the slot enabling the photograph to be viewed from the striking face of the golf club head.

A method of manufacture of a shaftless golf club head simulating a wood for mounted assembly to a decorative support base. My method includes the steps of cutting a concave center portion in a front face of the golf club head, the concave center portion being defined by opposed inclined edges, and cutting a photograph to a shape for marked disposition in the concave center portion. In one embodiment the photograph is utilized with a shaped frame design for more aesthetically pleasing viewing. The bottom surface of the photograph and frame design are secured to the concave center portion between the opposed inclined edges by a two-stage transparent epoxy application process. The two-stage epoxy application process is facilitated by the use of clay epoxy dams longitudinally extending from the open upper and lower ends of concave center portion, pouring a first layer of transparent epoxy into the concave center portion, allowing it to become tacky, and then placing a face plate or colorable insert onto the concave center portion, the face plate has a separate concave indentation, a photograph and frame design corresponding to the shape of the concave indentation. After the first epoxy application dries leaving the face plate fixedly positioned in the concave center portion, a layer of mortite putty is applied to the separate concave indentation to place a tacky surface onto which a photograph and its corresponding frame design can be placed. The mortite putty serves to prevent air pockets from forming underneath the photograph which detracts from the appearance of the photograph. A second application of transparent epoxy is then applied through the use of the clay dams whereby the transparent epoxy is poured into the concave indentation, filling the indentation, with the image of the photograph and frame design being viewable from a front face of the golf club head, removing the clay dams, finishing the exterior surface of the head and the front face to a desired state. In the second embodiment a photograph is cut to a desired shape for marked disposition in the concave center portion, tape means are provided possessing adhesion characteristics on opposite sides thereof, the adhesive tape surface on one side of the tape being secured to the bottom surface of the photograph, the adhesive on the opposite side of the tape securing the photograph in centered position in the concave center portion between the opposed inclined edges. Clay dams are provided on open upper and lower edges of the concave center portion to facilitate the pouring of a layer of transparent epoxy into the concave center portion, filling the concave center portion with the image of the photograph being viewable from a front face of the golf club head, removing the clay dam, finishing the exterior surface of the head and the front face to a desired state.

My invention further includes a flat heel or sole plate located on the underside of the golf club head and screwing means for securing the head and heel plate to a decorative support base. The head also includes a molten lead weight placed within the underside of the head to add overall mass to the head thereby facilitating a center of gravity to the head which aids in the proper mounting of the head onto the decorative support base.

One of the aspects of my invention is to provide a decorative golf club head photograph holder which allows for the fixed placement of a photograph in the striking face of the golf club head. The transparent epoxy found in my invention prevents misalignment of the photograph or movement in the striking face of the head and thereby insures that the appearance of the photograph and the overall impact of the head will be attractive. The golf club head of my invention further includes a shaft portion wound up on the golf club head.

Another object of my invention is to provide framing means for the photograph which can increase the attractive appearance of the photograph for the viewer. The framing means can be designed in a variety of shapes, such as a circle, square, or the like.

Still another object of my invention is to provide a heel plate to secure the head to a decorative support base in a smooth, even horizontal plane. The decorative support base can vary in size and shape depending upon the number of golf clubs heads placed upon the base.

A further object of my invention is to provide a trim ring placed onto the hosel section or shaft portion of the head to give the shaftless golf club head photograph holder on overall finished appearance.

Additional objects, advantages, and features of the present invention will become apparent from the following description and appended claims, taken in conjunction with the accompanying drawings.

DETAILED DESCRIPTION OF THE PREFERRED EMBODIMENTS

Figure 1:
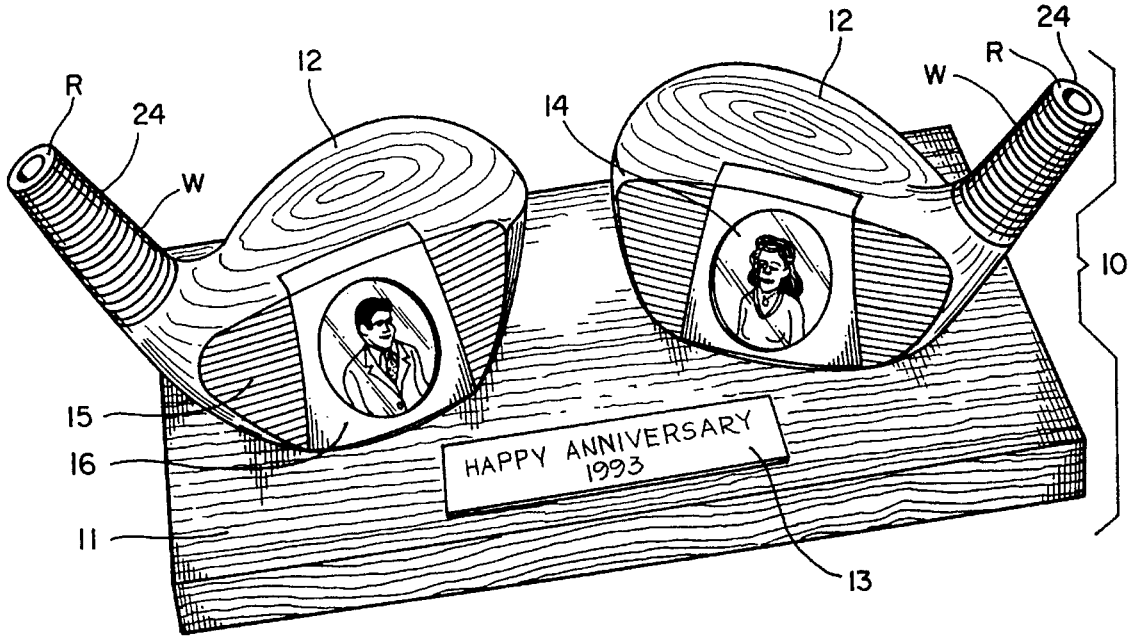
FIG. 1 is a perspective view of my shaftless golf club head photograph holder employing a framing means around the photograph and showing two golf clubs heads mounted upon a decorative support base.
Figure 4:
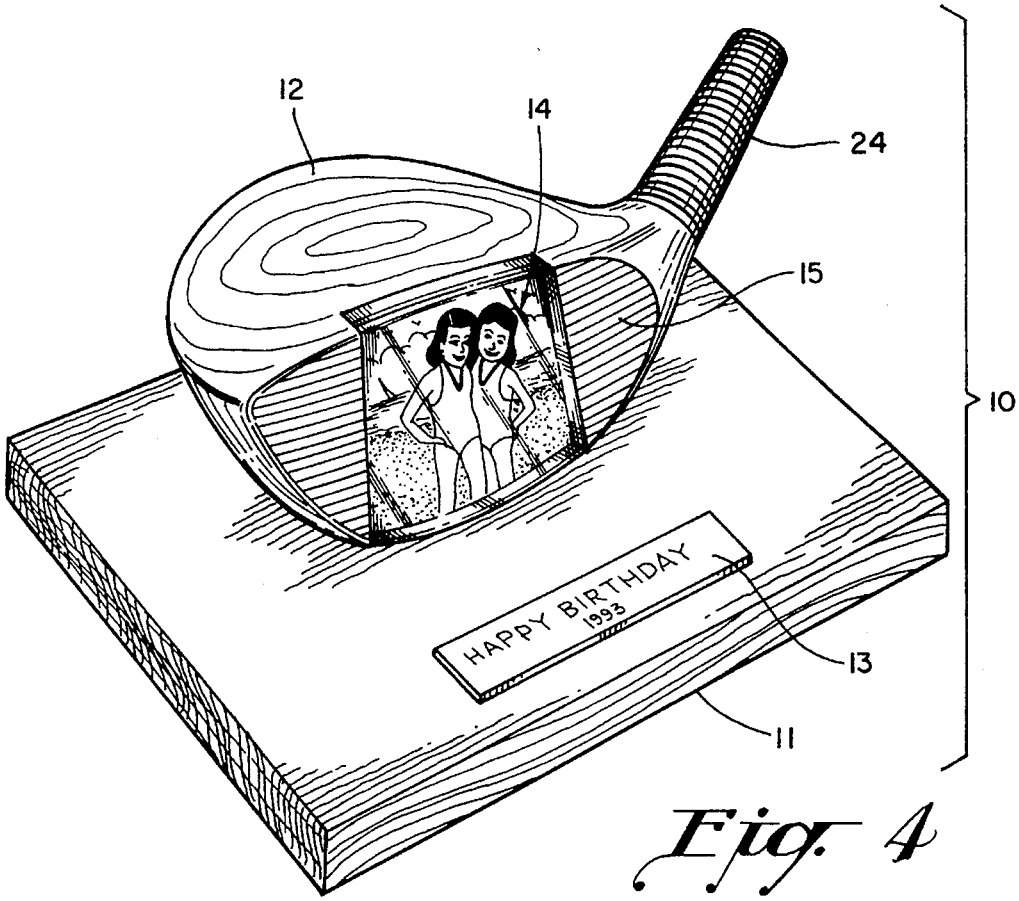
FIG. 4 shows a single shaftless golf club head mounted on a decorative support base showing a photograph without a framing means fixedly mounted within the striking face of the head.

The reference numeral 10 indicates generally the shaftless golf club head photograph holder of my invention. Reference numeral 12 refers to the hosel section or shaft portion of the head. The ornamental effect of my invention can be exemplified by a single head 10 on a decorative support base 11, as illustrated in FIG. 4 or two heads placed on a decorative support base 11, as illustrated in FIG. 1. An ornamental letter plate 13 is secured to the decorative support base 11 to commemorate in letters, words or symbols the nature or special meaning of the shaftless golf club head photograph holder 10 as chosen by the viewer.

Figure 2:
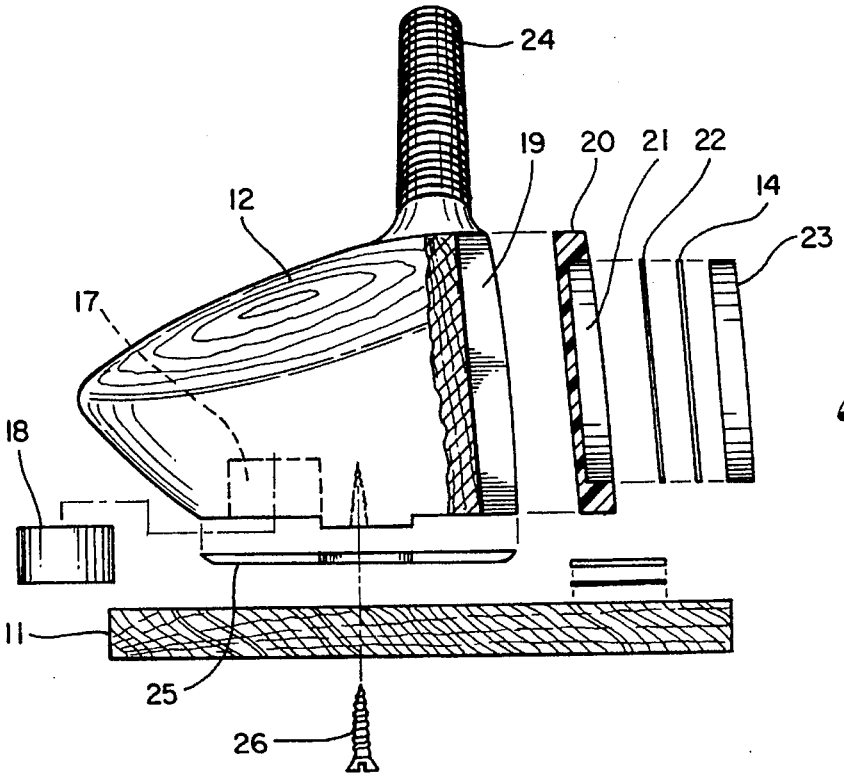
FIG. 2 is a partial side view of the shaftless golf club head showing a series of inserts including a photograph with a framing means which are placed into a drilled out striking face as well as screwing means which secure a decorative support base to a heel plate which is itself secured to the underside of the golf club head.

As seen in FIG. 1 a photograph 14 placed within the striking face 15 of the head 10 can be aesthetically enhanced by an ornamental framing means or design or insert 16 which can be drilled out in the shape of a circle, square or the like. Conversely, a photograph 14 can be placed and fixedly positioned within the striking face 15 without a framing means or design 16, as illustrated in FIG. 4. Turning now to FIG. 2, the underside of the head 10 of the present invention is drilled out to leave an opening in the underside of the head 17. A molten lead weight 18 of corresponding dimension to the underside head opening 17 is then placed within the opening 17 to add overall weight to the heat 10 and provide an increased center of gravity to the head 10.

Figure 3:
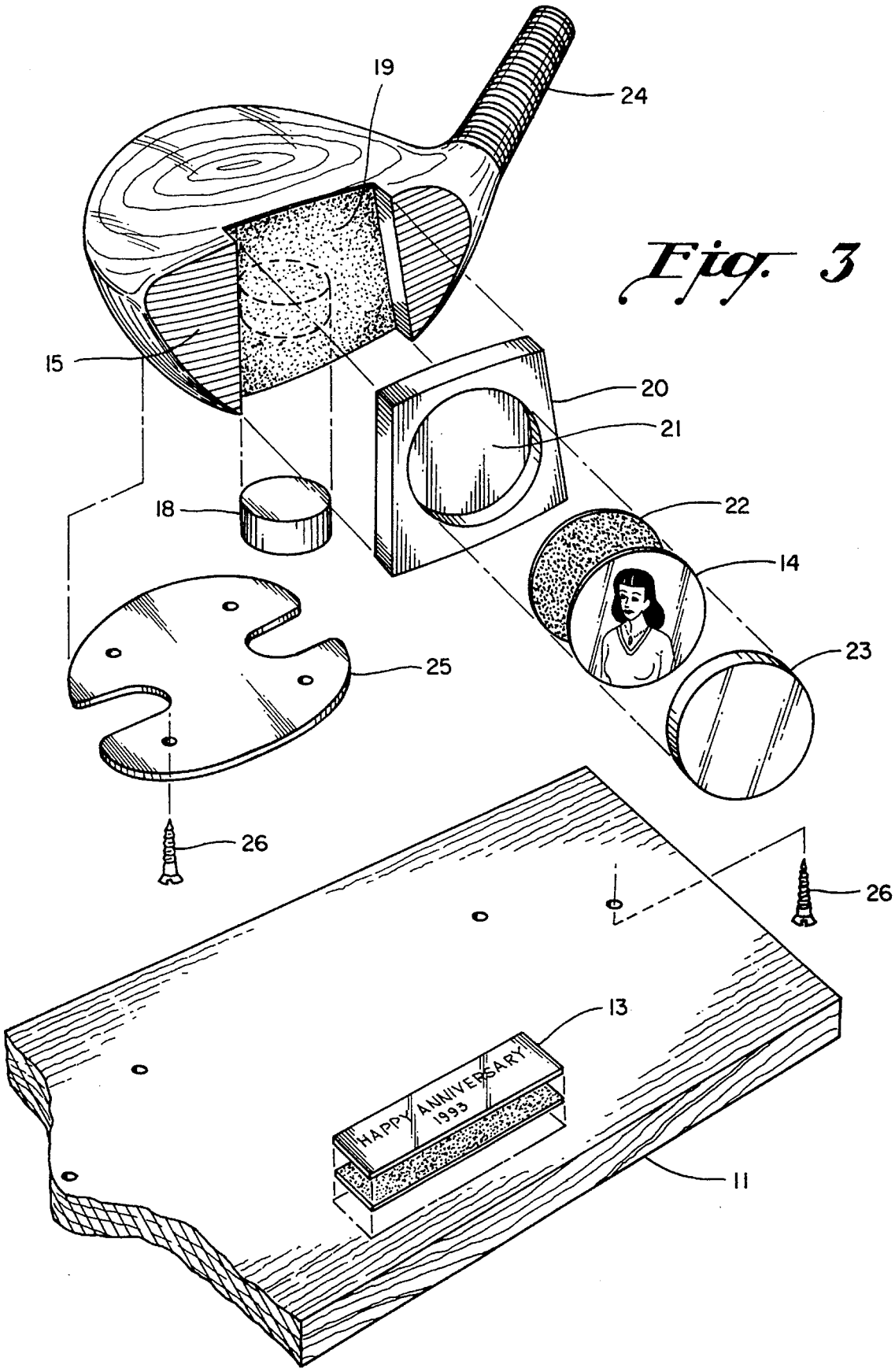
FIG. 3 is a telescoping component view of my golf club head showing the components of my two-stage transparent epoxy application process placing a photograph with framing means within the striking face of the golf club head as well as the screwing means employed from the decorative support base to secure the heel plate to the underside of the head.
Figure 7:
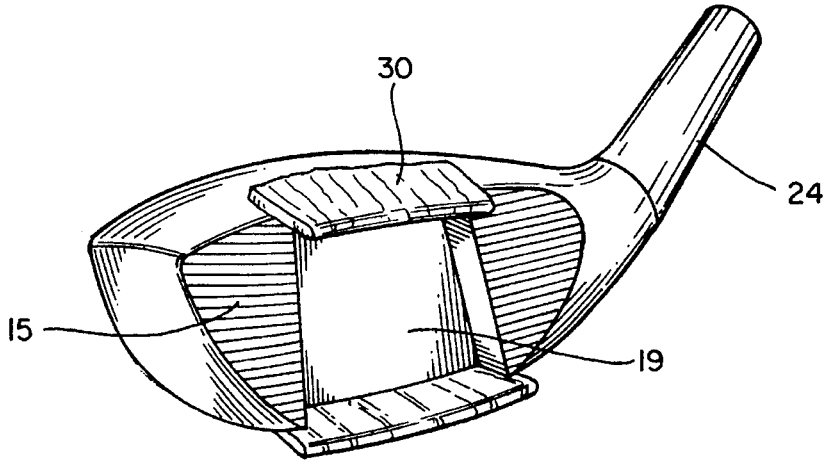
FIG. 7 is a partial perspective view of my shaftless golf club head showing the drilled out portion of the striking face with a pair of upper and lower clay dams which are put in place to facilitate the pouring of a transparent epoxy into the striking face of the golf club head.
Figure 8:
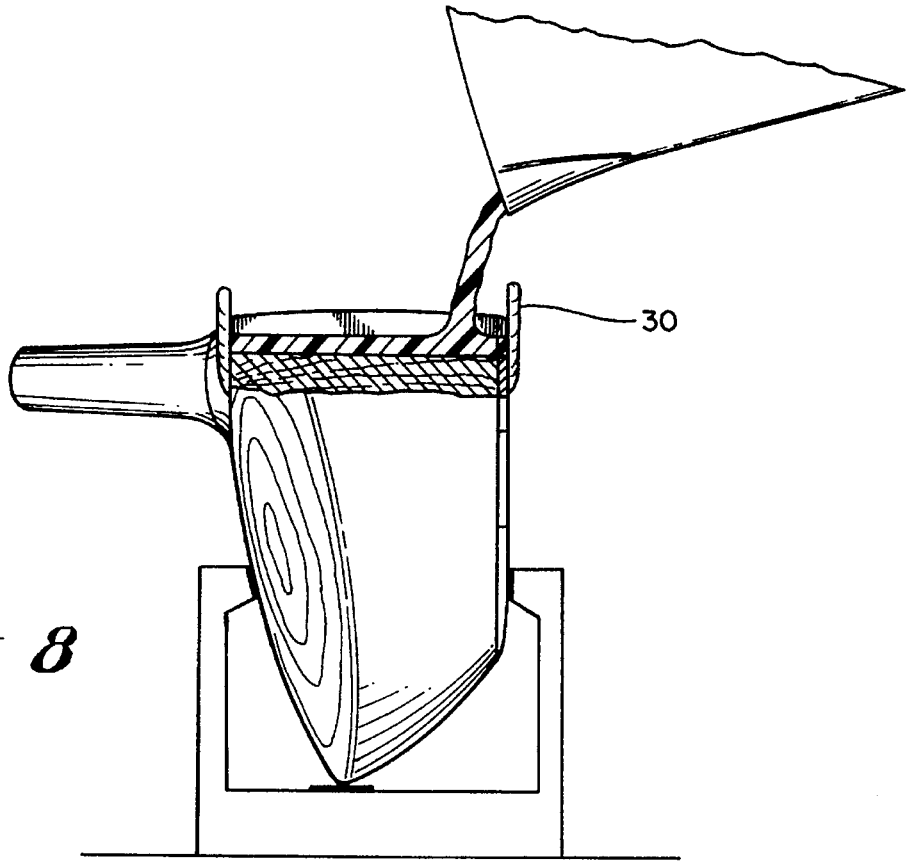
FIG. 8 is a perspective view of the shaftless golf club head placed within vise-like support means which allow for the even and efficient pouring of transparent epoxy through the use of the clay dams.

The striking face 15 of the head 10 possessing a concave center portion 19 capable of receiving a face plate or colorable insert 20 which can be fixedly mounted within the dimensions of the concave center portion 19 by a first layer of transparent epoxy applied to the center portion 19, as illustrated in FIG. 3. The first layer of transparent epoxy applied by utilizing a pair of upper and lower clay dams 30 which facilitate the pouring of the epoxy and inhibit spillage of material onto the head 10 which could disfigure the overall ornamental impact of the head 10, as illustrated in FIGS. 7 and 8. The face plate or colorable insert 20 having a center concave indentation 21 capable of receiving a first layer of transparent epoxy which prevents air pockets from being trapped beneath the photograph 14 which would diminish the overall appearance of the head 10. The photograph 14 is placed upon the first layer of transparent epoxy while the epoxy is in a tacky state. The first layer of epoxy thereby serving as adhesion means to fixedly mount and secure a photograph 14 within the center concave indentation 21. A second layer of transparent epoxy 23 then placed over the photograph 14 to protect and encase the photograph 14 and to prevent misalignment of the photograph or movement within the center concave indentation 21, as illustrated in FIG. 3.

The entire head 10 mounted upon a heel plate 25 providing an even horizontal planar surface which in turn is mounted upon the decorative support base 11. The base 10 having screw means 26 protruding from the underside of the base and securing the case 10, heel plate 25 and head 10 in a single mounted assembly.

Figure 5:
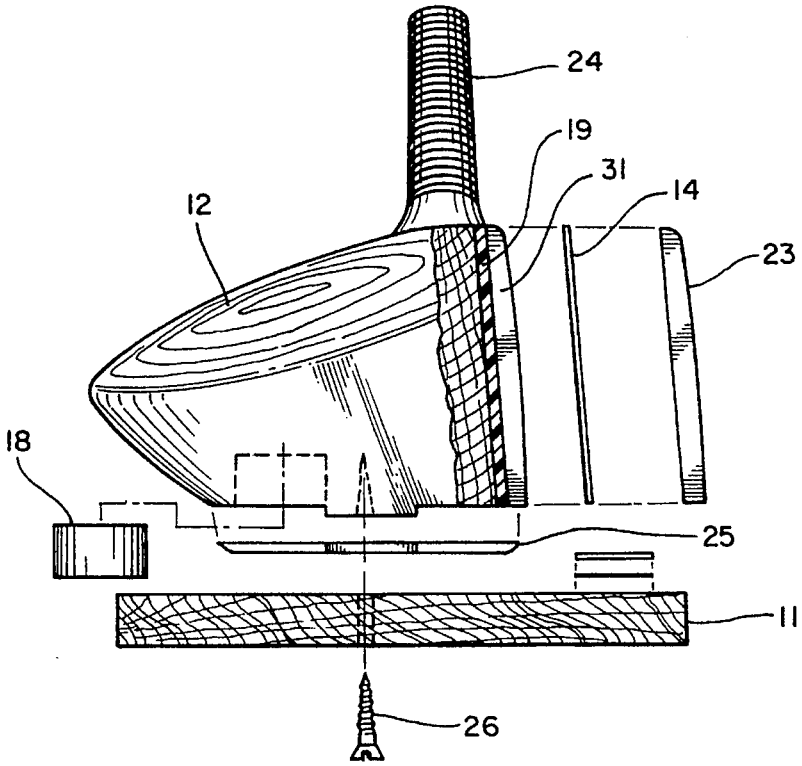
FIG. 5 is a partial side view of my shaftless golf club head photograph holder showing a series of inserts outwardly expanding from the striking face of the golf club head including a photograph without a framing means as well as screwing means for securing the golf club head onto a heel plate which is then secured to a decorative support base.
Figure 6:
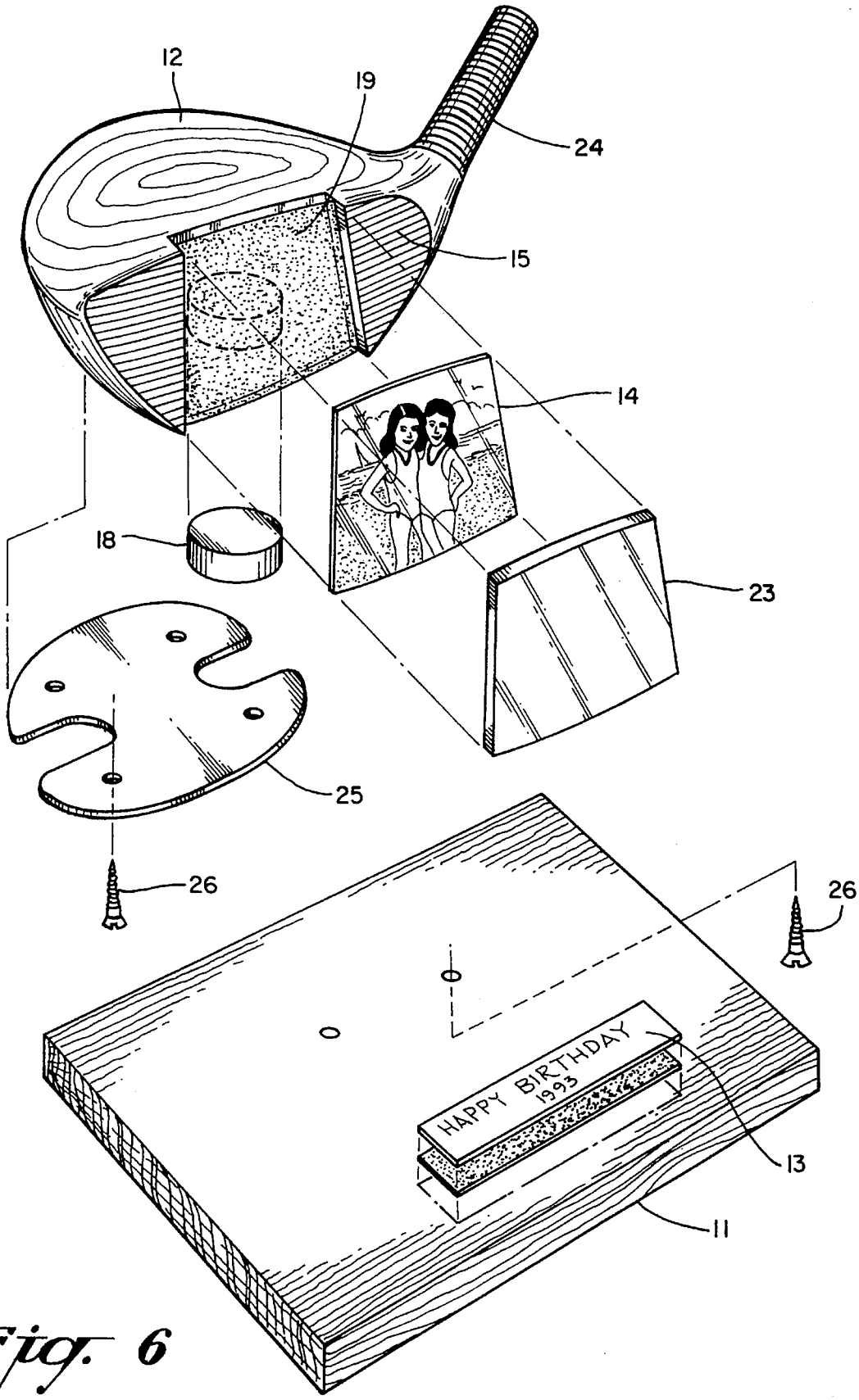
FIG. 6 is a telescoping component view of my shaftless golf club head photograph holder showing the high-impact strength epoxy application process with the striking face onto which a frameless photograph can be placed as well as screwing means which can secure a decorative support base to a sole or heel plate which is in turn secured to the shaftless golf club head.

In a second embodiment a head 10 is provided with a photograph 14 that is placed directly onto the concave center portion 19 by adhesive means or a dual-sided adhesive tape 31 having opposing adhesive tape surfaces on opposite sides thereof, as illustrated in FIG. 5. The adhesive on one side of the tape 31 being secured to the photograph 14, the adhesive on the opposite side of he tape 31 securing the photograph 14 in a centered position in the concave center portion 19. This tape means 31 prevents the photograph 14 from floating in the concave center portion 19 as well as providing consistency to the depth of the photograph in the concave center portion 19. In this embodiment, a single layer of transparent epoxy 32 is applied over the photograph 14 in the concave center portion 19 of the striking face 15, as illustrated in FIG. 6. This application of transparent epoxy 32 is facilitated by a pair of upper and lower clay dams 30, as illustrated in FIGS. 7 and 8.

As shown in FIGS. 5 and 6, the head 10 of this embodiment also has a drilled out underside portion 17 into which a molten lead weight 18 is placed to add weight to the head 10 for proper mounting upon a heel plate 25 for horizontal planar mounting upon a decorative support base 11 by screw means 26 protruding from the underside of the decorative support base 11, through the heel plate 25 and secured to the head 10 for an integrated mounted assembly effect.

It will be appreciated that the method of manufacture of my invention will include the following steps as an example:

1. My invention process begins with the purchase of what is generally referred to as a pro sanded wooden golf club head. The striking face of the head may vary in size from 1.5–2 inches. A pro sanded head can be describes as a rough sanded wooden head with the insert area or concave center portion routed into the striking face. I special order the heads so that the face plate or colorable insert is not attached.

2. Drill out the weight hole or underside portion as well as holes in front of and behind the drilled out underside portion.

3. Fill the drilled out underside portion with a weight device to increase the overall mass of the head.

4. Select a face plate or colorable insert and a transparent epoxy. Rough out or sand all edges of the colorable insert and concave center portion or insert area to insure good contact and adhesion.

5. Apply a layer of transparent or high-impact strength epoxy onto the concave center portion and place the colorable insert or face plate onto the transparent epoxy.

6. Dry for 24 hours.

7. File and rough sand the colorable insert or face plate to a smooth shape.

8. Drill out the desired insert shape or design for the chosen photograph. Drill sizes may range from ⅞ to 1.25 in diameter. Care must be taken to ensure that the drilling hole is placed into the insert or face plate at a 90 degree angle. My method of manufacture further includes a vise-like device that I use to hold the club head while in the stages of manufacture. This device allows me to adjust the position of the head to drill at a 90 degree angle. Without this method of drilling the photograph will appear at an angle in the striking face of the head. The striking face of the head is cut at a 10–11 degree angle. This is generally called loft. This process allows the photograph to be attached at a uniform depth in the insert or concave center indentation.

9. Select and cut a photograph to the correspondingly desired size, shape, and/or design.

10. Apply a filler, I use mortite putty, to fill and lever any indentations into the bottom of the drilled out portion of the insert caused during the drilling operation. These indentations can cause air pockets to form underneath the photograph detracting from the aesthetic value of the club face.

11. Apply a two-sided carpet tape to the underside of the photograph.

12. Place the photograph in the concave center indentation.

13. Using mortite putty and trailer tape (trailer tape is a metal tape with a tar like adhesive), build a dam around the photograph to contain any excess epoxy used when covering the photograph. These can be clay dams.

14. Cover the photograph and fill the concave center indentation with a clear high impact strength or transparent epoxy which can be commonly found in the prevailing consumer market.

15. Dry for 24 hours.

16. Remove the material used as a dam.

17. File the now dried insert or face plate to a rough shape with a course wood rasp.

18. Fine file the insert or face plate to a desired shape using a fine mill file.

19. Medium sand the head using 150 strict sandpaper.

20. Fine sand using 240 grit sandpaper.

21. Sand using 000 grade steel wool.

22. Buff using red rouge buffing compound. * Steps 18–22 are done to eliminate all scratches and give the insert or face plate a high luster and high gloss finish.

23. Wipe the striking face and entire head clean with naphtha.

24. Mask the striking face with polyurethane or face sealer to protect stain penetration in the striking face.

25. Attach the head to a ⅜" by 12" wooden dowel. I use masking tape wrapped around the dowel and hosel. The hosel is the shaft portion of the head.

26. Dip the head in stain of a desired color. Use a water based stain.

27. Dry for a minimum of 12 hours.

28. Apply on oil based wood filler. Allow 15 minutes to flash off.

29. Wipe the head clean of the filler using a 12"×12" piece of burlap.

30. Dry for 24 hours.

31. Remove the polyurethane or face sealer used to prevent stain penetration of the club.

32. Lightly sand, steel wool and buff as needed to regain a high gloss finish on the head.

33. Apply a primer/sealer to the head.

34. Dry for a minimum of 4 hours.

35. Apply a first court of polyurethane. Dip or spray depending upon the size of the head.

36. Dry for 24 hours.

37. Lightly steel wool using 000 grade to abrade finish and smooth surface.

38. Apply a second coat of polyurethane in the desired manner.

39. Dry for 24 hours.

40. Lightly sand with 400 grit sandpaper and steel wool with 000 grade. Abrade the surface and smooth any rough spots.

41. Apply a third coat of polyurethane in the desired manner.

42. Dry for 24 hours.

43. Remove dowel from the head.

44. Lightly sand the hosel to smooth out area to be whipped.

45. Dip the sanded area of the hosel in the chosen stain.

46. Dry for 2–4 hours.

47. Stretch and apply a trim ring to the top of the hosel. The color of the trim ring chosen to match, contrast, or add a different color to the head. Stretch using a needle nosed pliers, slip the trim ring as far as it will go down the nose of the pliers, opening the pliers using short, quick movements to gradually expand the plastic ring. Apply the ring using 1 drop of crazy glue.

48. Stain the top of the hosel.

49. Apply the whipping using the color of the viewer's choice.

50. Club is now ready to be applied to the heel plate and decorative support base desired. Decorative support bases may include: a flat base comprising of a square or rectangular piece of hardwood such as walnut oak or cherry with an ornamental letter plate attached where the size of the base may vary due to the number of heads to be mounted or bookends consisting of two pieces of hardwood attached at a 90 degree using a dovetail joint with an ornamental letter plate attached.

The foregoing discussion discloses and describes merely exemplary embodiments of the present invention. One skilled in the art will readily recognize from such discussion, and from the accompanying drawings and claims, that various changes modifications and variations can be made therein without departing from the spirit and scope of the invention as defined in the following claims.

I claim:

1. A shaftless golf club head photograph holder having an inclined surface simulating a striking face of a wood-type golf club, the face having a concave center portion, the improvement of a photograph having corresponding length and width dimensions to length and width dimensions of said concave center portion, an adhesive tape, said tape having adhesive characteristics on opposite sides thereof, the adhesive on one side of the tape being secured to a bottom face of the photograph, the adhesive on the opposite side of the tape being secured to said concave center portion to maintain the photograph, a layer of transparent epoxy engaged over the photograph encasing and securing said photograph is a fixed position in said concave center portion enabling the photograph to be viewed from said striking face of the shaftless golf club head, the holder having a recessed underside portion, a weight of corresponding dimension to said recessed underside portion is mounted within the recessed underside portion, said holder mounted on a heel plate, the heel plate providing support means to fixedly secure said weight in said recessed underside portion, said heel plate mounted on a decorative support base, said base having an ornamental letter plate affixed to a top of the base enabling unobstructed viewing of said ornamental letter plate, screw means protruding up from an underside of the decorative support base through the top of said base into said heel plate through said heel plate into said head connecting said head to said heel plate to said base in mounted fixed assembly therein, said screw means securing said head in a fixed horizontally planar manner mounted upon said decorative support base.

2. The shaftless golf club head photograph holder of claim 1 wherein the holder includes a club head, the club head has a hosel shaft extending upward from said club head, said hosel shaft having a trim ring protruding from an end of said hosel shaft providing a smooth and finished appearance to said hosel shaft.

3. A shaftless golf club head photograph holder having an inclined surface, the inclined surface comprising a striking face of a wood-type golf club, the face having a concave center portion, the holder having a photograph having corresponding length and width dimensions to length and width dimensions of said concave center portion, means secured to a bottom face of the photograph, said means also being secured to said concave center portion to maintain the photograph in a centered position in said concave center portion to avoid misalignment of the photograph, a layer of transparent epoxy engaged over the photograph encasing and securing said photograph in a fixed position in said concave center portion enabling the photograph to be viewed from said striking face of the shaftless golf club head, the holder having a recessed underside portion, a weight of corresponding dimension to said recessed underside portion is mounted within the recessed underside portion, said holder mounted on a heel plate, the heel plate providing support means to fixedly secure said weight in said recessed underside portion, said heel plate mounted on a decorative support base, said base having an ornamental letter plate affixed to a top of the base enabling unobstructed viewing of said ornamental letter plate, and screw means protruding up from an underside of the decorative support base through the top of said base into said heel plate through said heel plate into said head connecting said head to said heel plate to said base in mounted fixed assembly therein, said screw means securing said head in fixed horizontally planar manner mounted upon said decorative support base, said screw means extending into said head providing drains means for excess epoxy to leak into said head from said striking face.

4. The shaftless golf club head photograph holder of claim 3 wherein said means comprises a dual sided adhesive tape, adhesive on one side of the tape being secured to the photograph, adhesive on another opposing side of the tape securing the photograph in a centered position in said concave center indentation to avoid misalignment of said photograph.

5. The shaftless golf club head photograph holder of claim 3 wherein said means is comprised of epoxy, the epoxy securing the photograph in a centered position in said concave center indentation to avoid misalignment of the photograph and prevent air pockets from forming on an underside of said photograph.

6. A shaftless golf club head shaped photograph holder including a head, the head having an inclined surface face of a wood-type golf club, the face having a concave center portion, the holder having a photograph having corresponding length and width dimensions to length and width dimensions of said concave center portion, an adhesive tape, said tape having adhesive characteristics on opposite sides thereof, the adhesive on one side of the tape being secured to a bottom face of the photograph, the adhesive on the opposite side of the tape being secured to said concave center portion to maintain the photograph in place, a layer of transparent epoxy engaged over the photograph encasing and securing said photograph in a fixed position in said concave center portion enabling the photograph to be viewed from said striking face of the shaftless golf club head shaped photograph holder, the holder has a recessed underside portion, a weight of corresponding dimension to said recessed underside portion is mounted within the recessed underside portion, said holder mounted on a heel plate, the heel plate providing support means to fixedly secure said weight in said recessed underside portion, said heel plate mounted on a decorative support base, said base having an ornamental letter plate affixed to a top of the base enabling unobstructed viewing of said ornamental letter plate, screw means protruding up from an underside of the decorative support base through the top of said base into said heel plate through said heel plate into said head connecting said head to said heel plate to said base in mounted fixed assembly together, said screw means securing said head in a fixed horizontally planar manner mourned upon said decorative support base.

7. A shaftless golf club head configured photograph holder including a head, the head having an inclined surface which simulates a striking face of a wood-type golf club, the face having a concave center portion, the holder having a photograph with corresponding length and width dimensions to length and width dimensions of said concave center portion, means secured to a bottom face of the photograph, said means also being secured to said concave center portion to maintain the photograph in a centered position in said concave center portion to avoid misalignment of the photograph, a layer of transparent epoxy engaged over the photograph encasing and securing said photograph in a fixed position in said concave center portion enabling the photograph to be viewed from said striking face of the shaftless golf club head configured photograph holder, the holder has a recessed underside portion, a weight of corresponding dimension to said recessed underside portion is mounted within the recessed underside portion, said holder mounted on a heel plate, the heel plate providing support means to fixedly secure said weight in said recessed underside portion, said heel plate mounted on a decorative support base, said base having an ornamental letter plate affixed to a top of the base enabling unobstructed viewing of said ornamental letter plate, screw means protruding up from an underside of the decorative support base through the top of said base into said heel plate through said heel plate into said head connecting said head to said heel plate to said base in mounted fixed assembly together, said screw means securing said head in fixed horizontally planar manner mounted upon said decorative support base, said screw means extending into said head providing drains means for excess epoxy to leak into said head from said striking face.

* * * * *